US010206440B2

(12) United States Patent
Treyger

(10) Patent No.: US 10,206,440 B2
(45) Date of Patent: Feb. 19, 2019

(54) CONVERTIBLE APPAREL

(71) Applicant: Liliya Treyger, Staten Island, NY (US)

(72) Inventor: Liliya Treyger, Staten Island, NY (US)

( * ) Notice: Subject to any disclaimer, the term of this patent is extended or adjusted under 35 U.S.C. 154(b) by 0 days.

(21) Appl. No.: 15/690,205

(22) Filed: Aug. 29, 2017

(65) Prior Publication Data

US 2017/0360126 A1 Dec. 21, 2017

Related U.S. Application Data

(63) Continuation-in-part of application No. 15/350,090, filed on Nov. 13, 2016.

(60) Provisional application No. 62/381,038, filed on Aug. 30, 2016, provisional application No. 62/255,551, filed on Nov. 16, 2015.

(51) Int. Cl.

| | |
|---|---|
| ***A41D 15/04*** | (2006.01) |
| ***A41D 15/00*** | (2006.01) |
| ***A41D 27/10*** | (2006.01) |
| ***A41D 23/00*** | (2006.01) |
| ***A41D 1/04*** | (2006.01) |
| ***A41D 1/18*** | (2006.01) |
| *A41D 1/14* | (2006.01) |

(52) U.S. Cl.

CPC ..... *A41D 15/00* (2013.01); *A41D 1/04* (2013.01); *A41D 1/18* (2013.01); *A41D 23/00* (2013.01); *A41D 27/10* (2013.01); *A41D 1/14* (2013.01); *A41D 15/007* (2013.01); *A41D 2300/30* (2013.01); *A41D 2300/324* (2013.01); *A41D 2400/424* (2013.01)

(58) Field of Classification Search

CPC ..... A41D 15/04; A41D 15/00; A41D 27/10; A41D 1/00; A41D 1/04; A41D 3/00; A41D 13/08; A41D 13/0512; A41D 2023/004; A41D 15/005; A41D 15/02; A41D 27/00

See application file for complete search history.

(56) References Cited

U.S. PATENT DOCUMENTS

| | | | | |
|---|---|---|---|---|
| 220,519 A | | 10/1879 | Buss | |
| 1,284,536 A | * | 11/1918 | Yaeger | A41D 13/08 2/59 |
| 1,285,917 A | * | 11/1918 | Smith | A41D 1/04 2/158 |
| 2,099,431 A | * | 11/1937 | Reeb | A41D 27/10 2/126 |
| 2,237,368 A | * | 4/1941 | Seitzman | A41D 15/00 2/91 |

(Continued)

OTHER PUBLICATIONS

Neck Wrap, available Aug. 3, 2012, [online], [site visited Nov. 13, 2014]. Available from internet, <URL: http://sanitystitches.blogspot.com/2012/08/fall-neck-wrap-pattern-and-tutorial.html.

(Continued)

*Primary Examiner* — Robert H Muromoto, Jr.
(74) *Attorney, Agent, or Firm* — Mestechkin Law Group P.C.

(57) ABSTRACT

A multipurpose customizable garment designed to be transformed from the form of arm-wear into other types of garments. Specifically, the multipurpose customizable garment can be converted from a top to bustier, dress by selective use of detachable sleeves and selective use of a plurality of fasteners enabling the wearer to vary the size and appearance of the garment.

13 Claims, 8 Drawing Sheets

(56) References Cited

U.S. PATENT DOCUMENTS 2,326,422 A * 8/1943 Weisberger ..... A41D 13/08 2/59
2,382,396 A * 8/1945 Carlu ..... A41D 5/00 2/126
2,510,720 A * 6/1950 Siegel ..... A41D 23/00 2/65
2,670,470 A * 3/1954 Manheim ..... A41D 15/04 2/69.5
2,804,626 A * 9/1957 Rossiter ..... A41D 23/00 2/207
3,036,450 A * 5/1962 Holder ..... A42B 1/045 2/206
D193,760 S 10/1962 Sanders
3,088,119 A * 5/1963 Grant ..... A41D 23/00 2/130
3,286,276 A * 11/1966 Calisch ..... A41D 23/00 2/207
3,310,052 A * 3/1967 Ward, Jr. ..... A41C 1/04 450/97
3,646,614 A 3/1972 Engelmann
3,843,972 A 10/1974 Weinkle
4,055,853 A * 11/1977 Argento ..... A41D 3/00 2/247
4,347,629 A * 9/1982 Itoi ..... A41D 3/00 2/108
4,404,688 A * 9/1983 Knight ..... A41D 23/00 2/203
4,559,647 A * 12/1985 Smith ..... A41D 15/007 2/158
4,570,267 A * 2/1986 Appel ..... A41B 9/06 2/91
4,654,897 A * 4/1987 Rosaen ..... A41D 23/00 2/207
4,706,304 A * 11/1987 Jones ..... A41D 1/04 2/91
4,977,622 A * 12/1990 Schley ..... A41D 13/12 2/114
5,115,517 A * 5/1992 Ferguson ..... A42B 1/045 2/171
5,131,096 A * 7/1992 Olson ..... A41D 11/00 2/69
5,226,193 A * 7/1993 Chen ..... A41B 13/06 2/69
D364,722 S * 12/1995 Kallonakis ..... D2/502
5,673,836 A * 10/1997 Bush ..... A41D 13/00 2/94
5,774,892 A * 7/1998 Tisdale ..... A41D 1/06 2/115
5,815,833 A * 10/1998 Kuo ..... A41D 15/04 2/69.5
5,867,835 A * 2/1999 Dabbieri ..... A41D 23/00 2/171
5,918,312 A * 7/1999 Craren ..... A41D 13/00 2/102
5,996,121 A * 12/1999 Harris ..... A41D 15/04 2/108
6,047,404 A * 4/2000 Blanks, I ..... A41D 15/00 2/108
6,247,178 B1 * 6/2001 Bilda ..... A41B 13/06 2/126
D446,381 S 8/2001 Garfield
D448,540 S * 10/2001 Smith ..... D2/502
6,385,775 B1 * 5/2002 Komjati ..... A41D 15/04 2/86
6,665,876 B1 * 12/2003 Newman ..... A41D 13/08 2/207
6,971,566 B1 * 12/2005 Sartena ..... A45F 3/02 2/122
7,231,670 B2 * 6/2007 Chang ..... A41D 23/00 2/207
7,290,293 B2 * 11/2007 Kanitz ..... A41D 23/00 2/172
D565,277 S * 4/2008 Gibson ..... D2/600
D569,079 S * 5/2008 Whong ..... D2/502
7,392,549 B1 * 7/2008 Barber ..... A41D 13/0012 2/269
D575,936 S * 9/2008 Fenderson ..... D2/864
7,591,025 B2 * 9/2009 McGhee ..... A42B 1/041 2/202
7,908,669 B2 * 3/2011 Amson ..... A41D 27/12 2/207
D639,024 S * 6/2011 Benderradji ..... D2/501
8,006,318 B2 * 8/2011 Gallo ..... A41D 23/00 2/207
D646,468 S * 10/2011 Arrindell ..... D2/858
D649,742 S * 12/2011 Myrick ..... D2/502
D654,247 S * 2/2012 Osbourne ..... D2/702
8,251,933 B2 * 8/2012 Farrow ..... A61H 9/005 602/13
D677,448 S * 3/2013 Bazile ..... D2/728
D677,797 S 3/2013 Godfrey
8,479,315 B2 * 7/2013 Kelling ..... A41D 15/04 2/69
8,505,117 B2 * 8/2013 Park ..... A41D 23/00 2/202
D698,117 S 1/2014 King
D698,129 S 1/2014 Marz
D713,137 S 6/2014 Wahib
D710,068 S 8/2014 Garcia
9,009,866 B2 * 4/2015 Blakely ..... A41B 7/04 2/124
9,055,775 B2 * 6/2015 Taul ..... A41D 23/00
D737,019 S * 8/2015 Jensen ..... D2/502
9,149,078 B1 * 10/2015 Curtin ..... A41D 23/00
9,226,532 B2 * 1/2016 Orozco ..... A41D 11/00
9,723,882 B2 * 8/2017 Reuben ..... A41D 15/04
9,826,787 B2 * 11/2017 Wu ..... A41D 13/11
2005/0164598 A1 * 7/2005 Kelsey ..... A63H 3/52 446/296
2006/0070183 A1 4/2006 Ekins
2006/0137072 A1 * 6/2006 Visco ..... A41D 15/04 2/127
2006/0224069 A1 10/2006 Sano
2007/0179421 A1 * 8/2007 Farrow ..... A61H 9/005 602/75
2009/0000005 A1 * 1/2009 Amson ..... A41D 23/00 2/48
2009/0320175 A1 * 12/2009 Shih ..... A41D 15/00 2/69
2010/0199399 A1 * 8/2010 Garza ..... A41D 15/002 2/24
2010/0281601 A1 * 11/2010 Clarke ..... A41D 1/08 2/236
2011/0126340 A1 * 6/2011 Wu ..... A41D 13/11 2/88
2012/0079644 A1 * 4/2012 Benderradji ..... A41D 23/00 2/207
2013/0198934 A1 * 8/2013 Marquez ..... A41D 23/00 2/171
2014/0115763 A1 * 5/2014 Orozco ..... A41D 11/00 2/455
2015/0071978 A1 * 3/2015 Chang ..... A61N 2/06 424/402
2016/0050994 A1 * 2/2016 Bushby ..... A41D 27/10 2/243.1
2016/0165975 A1 * 6/2016 Reuben ..... A41D 15/04 2/69.5
2017/0044695 A1 * 2/2017 Hays ..... D02J 1/00
2017/0145596 A1 * 5/2017 Hays ..... B32B 5/026

OTHER PUBLICATIONS

Neck Warmer, available Dec. 7, 2012, [online], [site visited Nov. 13, 2014]. Available from internet, <URL: https://capedcrocheter.wordpress.com/2012/12/07/marians-neck-warmer/.

Leather Cuff, available Nov. 2, 2010, [online], [site visited Nov. 13, 2014]. Available from internet, <URL: http://sonodasilver.com/

(56) References Cited

OTHER PUBLICATIONS

A-306-brown-genuine-nubuck-leather-cuff-with-braided-design-and-adjustable-silvertone-snap-closure-.
New Form Perspective, available online, [site visited Nov. 30, 2017]. Available from internet, <URL: http://nfpstudio.com/about/bio/.
Nfpstudio Instagram, available online, [site visited Nov. 30, 2017]. Available from internet, <URL: https://www.instagram.com/nfpstudio/?hl=en.

* cited by examiner

CONVERTIBLE APPAREL

CROSS-REFERENCES TO RELATED APPLICATIONS

This application is a continuation-in-part of U.S. patent application Ser. No. 15/350,090 entitled "Hybrid Apparel and Method of Transforming Same Into Other Garment Types" filed Nov. 13, 2016, which claims the benefit of U.S. Provisional Patent Application No. 62/255,551 entitled "Armwear and Method of Transforming Same into a Neckwear" filed Nov. 16, 2015, and U.S. Provisional Patent Application No. 62/381,038 entitled "Convertible Apparel" filed Aug. 30, 2016, the entire respective disclosures of which are incorporated herein by reference.

BACKGROUND

Field of the Invention

The present invention is related generally to improvements in the field of wearable hybrid apparel. More specifically, the present invention provides customizable arm-wear and method for transforming same into neckwear or into one of several alternative garment types.

Description of Related Art

Although there are currently several different types of wearable hybrid apparel, few of them are designed with convenience in mind and each of them has certain disadvantages. For example, traditional wearable hybrid apparel does not provide for the additional uses or reconfigurations of detachable parts as an alternative type of wear, thereby necessitating storage of the removed parts of the apparel. In one example, traditional scarves typically cannot be used as any other form or type of wear. Also, while there are various types of apparel having sleeves, there are no types of apparel that allow its wearer to use the sleeves for any other purposes.

The design of currently available hybrid apparel suffers from a variety of other drawbacks as well. Due to the lack of customizability and versatility, the established designs are limited to either having detachable components and to serving one or two clothing functions without enabling the user to change the garment into one of a different type. This is because the current traditional hybrid apparel does not provide for modular, detachable, and reconfigurable elements which can serve different clothing purposes. Accordingly, the existing wearable hybrid apparel typically lacks versatility. Consequently, because this drawback significantly limits the variability of apparel, this results in narrow profit margins in highly competitive clothing industry. For the foregoing reasons, there is an ongoing need for versatile clothing designs that combine economy and ease of manufacture with ease and customizability of use and an aesthetically pleasing appearance. These and other features and advantages of the present invention will be explained and will become obvious to one skilled in the art through the summary of the invention that follows.

SUMMARY

The present invention is directed to an article of manufacture and a method of use relating thereto that meets the abovementioned needs and addresses the deficiencies noted above. Accordingly, it is an object of the present invention to provide a highly customizable and versatile article of wearable apparel that can be configured and combined to a variety of alternative modular garments. In particular, embodiments of the present invention are directed to articles of wearable apparel the elements of which are designed to transform into garments of a different type or category by selectively combining (or detaching) one or more elements of wearable apparel, thereby creating a garment that is of a different type than as originally configured.

A preferred embodiment of the invention provides an article of apparel having a bodice and a plurality of detachable sleeves, where each of the plurality of detachable sleeves is manufactured using a flat, pliable, and substantially rectangular or, alternatively, a substantially tubular element. Detachable sleeves are constructed to be detachably connected to each other such that the cuff of one detachable sleeve is detachably attached to the cuff of one other detachable sleeve by a plurality of fasteners, thereby creating an additional article of apparel. For example, the plurality of detachable sleeves detachably connected to each other forms a headwear, such as a headband. Alternatively, the plurality of detachable sleeves detachably connected to each other forms a scarf, a belt, and the like.

A bodice disclosed herein is constructed to be worn as a top, tunic, vest, a t-shirt, and the like, or it can be worn upside down, as a bustier or a skirt, where a hem line of a top becomes a waist line of a skirt or a neckline of a bustier.

The embodiments described herein along with others permit a user or wearer to easily configure and transform an article of apparel of one type into a garment of another type that is usually worn in a different manner or for different purposes by a wearer. The embodiments of the present invention also provide for unprecedented versatility in the designs of the garments that can be created or configured therefrom.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

These and other features, aspects, functions, and advantages of the present invention will become better understood with respect to the following description, appended claims, and accompanying drawings where:

DETAILED SPECIFICATION

Figure 1:
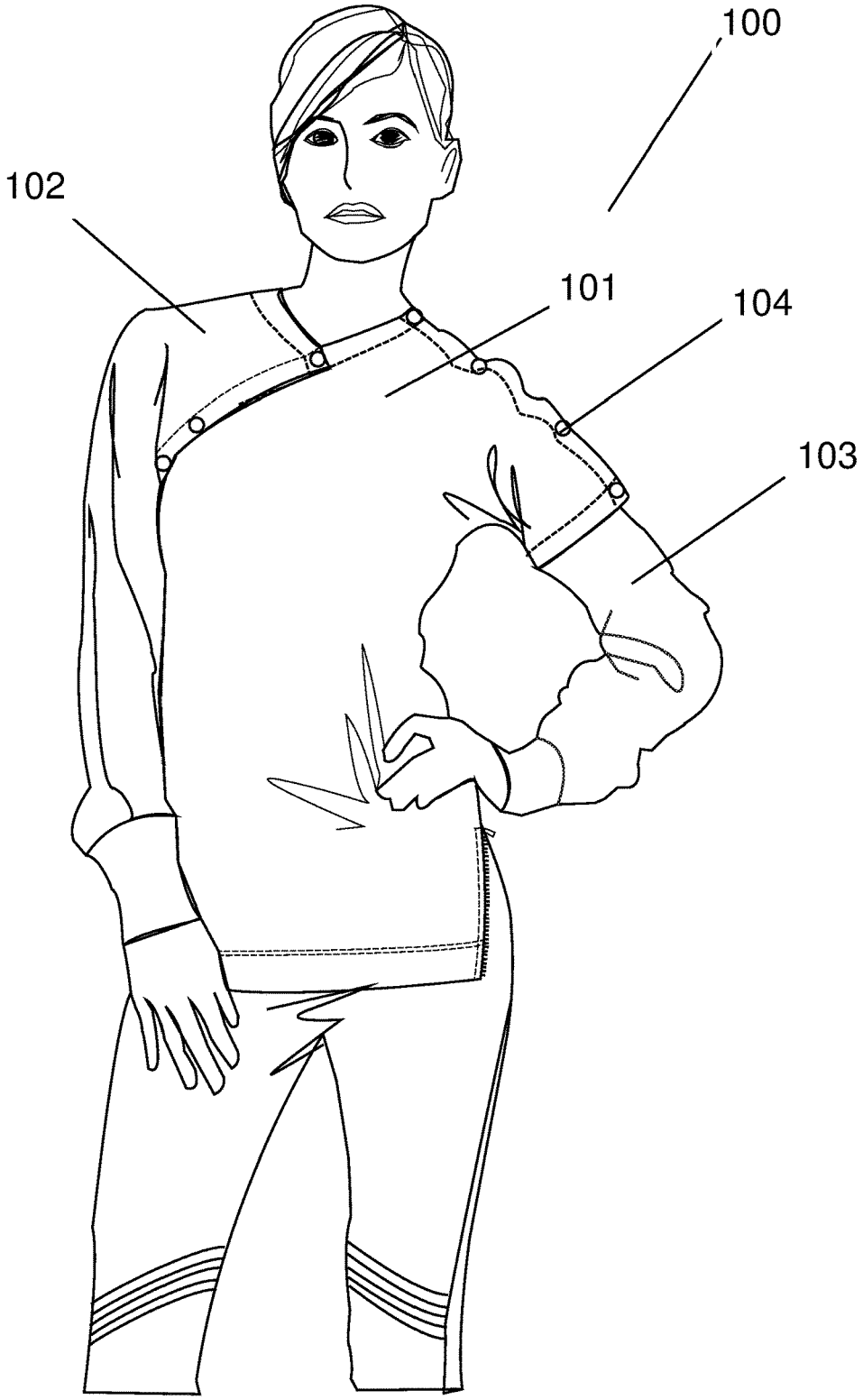
FIG. 1 illustrates a convertible apparel worn by a wearer in its configuration of a top or a blouse, in accordance with an embodiment of the present invention.

In the Summary above, in the Detailed Specification, the Claims below, and in the accompanying drawings, reference is made to particular features, including method steps, of the invention. It is to be understood that the disclosure of the invention in this specification includes a plurality of combinations of such particular features. For example, where a particular feature is disclosed in the context of a claim, that feature can also be used to the extent possible, in combination with and/or in the context of other particular aspects and embodiments of the invention and in the invention generally.

The term "comprises" and grammatical equivalents thereof are used herein to mean that other components, ingredients, steps, etc. are optionally present. For example, an article "comprising" (or "which comprises") components A, B, and C can consist of (i.e. contain only) components A, B, and C or can contain not only components A, B, and C but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context exclude that possibility).

The term "at least" followed by a number is used here into the note the start of a range beginning with that number (which may be a range having an upper limit or no upper limit, depending on the variable being defined). For example, "at least one" means one or more than one. The term "at most" followed by a number is used here into the note the end of a range ending with that number (which may be a range having 1 or 0 as its lower limit, or a range having no lower limit, depending upon the variable being defined). For example, "at most 4" means four or less than 4, and "at most 40%" means 40% or less than 40%. When, in the specification, a range is given as "(a first number) to (a second number)" or "(a first number)—(a second number)," this means a range whose lower limit is the first number and whose upper limit is the second number. For example, 25 to 100 mm means a range whose lower limit is 25 mm, and whose upper limit is 100 mm.

The terms "garment", "apparel", and "clothing" may be used interchangeably herein. It is to be understood that each of these terms may refer to an item that is comprised of one or more elements which are also referred to by one of these terms. For the sake of clarity, as used herein, a "garment" may comprise one or more items of "apparel" and vice versa. Similarly, as used herein, an item of "clothing" may comprise one or more articles of "apparel" and vice versa.

Embodiments of the present invention encompass hybrid apparel and garments equipped with a plurality of fasteners. More specifically, embodiments of the present invention are directed to articles of clothing which designed for convenient reconfiguration and combination with other articles of clothing. Unique modular aspects of the present invention provide for wearable garments to be formed by combining elements of apparel each of which are independently wearable as distinct articles of clothing. Further, as described in more detail below, embodiments of the present invention are directed to hybrid apparel articles which are customizable in the sense that they can be reconfigured from one type of garment into another type of garment through the selective use of fasteners. It is to be understood that plurality of fasteners can be buttons, snaps, clips, laces, Velcro, zippers, strips of hook-and-loop material, and the like. It should be noted that plurality of fasteners may be used without departing from the spirit of the invention as all the embodiments of the present invention are contemplated to function with any suitable fasteners.

A preferred embodiment of the invention provides an article of apparel having detachable sleeves, where each detachable sleeve is manufactured using a flat, pliable, substantially rectangular element in one variation, or a substantially tubular element in another variation. Each rectangular element is equipped with fasteners. A first plurality of fasteners is attached to the first surface of the rectangular element proximate to its first end, and second plurality fasteners attached to the second surface of the rectangular element proximate to its second end. The first and second ends of the rectangular element are securely fastenable to each other at the first and second fasteners. The first and second fasteners are positioned such that when the first end is attached to the second end, the rectangular element forms a tube having inner and outer circumferential surfaces provided by the first and second exterior surfaces of the rectangular element. The tube is dimensioned to fit around a wearer's arm and can function as a detachable sleeve that can be connected to another garment or worn independently.

A preferred embodiment of the invention also includes a method of converting a first multipurpose customizable garment into a second multipurpose customizable garment by detaching detachable sleeves from a torso element, rotating the torso element upside down, and adjusting dimensions of the lower opening using a dimension-regulating element situated in a close proximity to the lower opening.

FIG. 1 illustrates a convertible apparel 100 worn by a wearer in its configuration of a top or a blouse, wherein convertible apparel comprises a bodice 101 and a pair of detachable sleeves 102 and 103. Detachable sleeves 102 and 103 are detachably attached to bodice 101 by a plurality of fasteners 104. In one embodiment, detachable sleeve 103 is not connected to bodice 101 by fasteners 104. The plurality of fasteners 104 dispersed on the surfaces of bodice 101 and detachable sleeves 102 and 103. The plurality of fasteners 104 may be any fasteners suitable for removably connecting one element of the convertible apparel 100 to another element of convertible apparel 100 and are therefore not limited in size, shape, or function to those shown in the accompanying drawings. Preferably, the fasteners 104 are positioned in proximity to the ends of bodice 101 as well as detachable sleeves 102 and 103. The plurality of fasteners 104 may, but are not required to, be complementary to one another and may also be of disparate types permitting them to connect to other garment fasteners.

Figure 2:
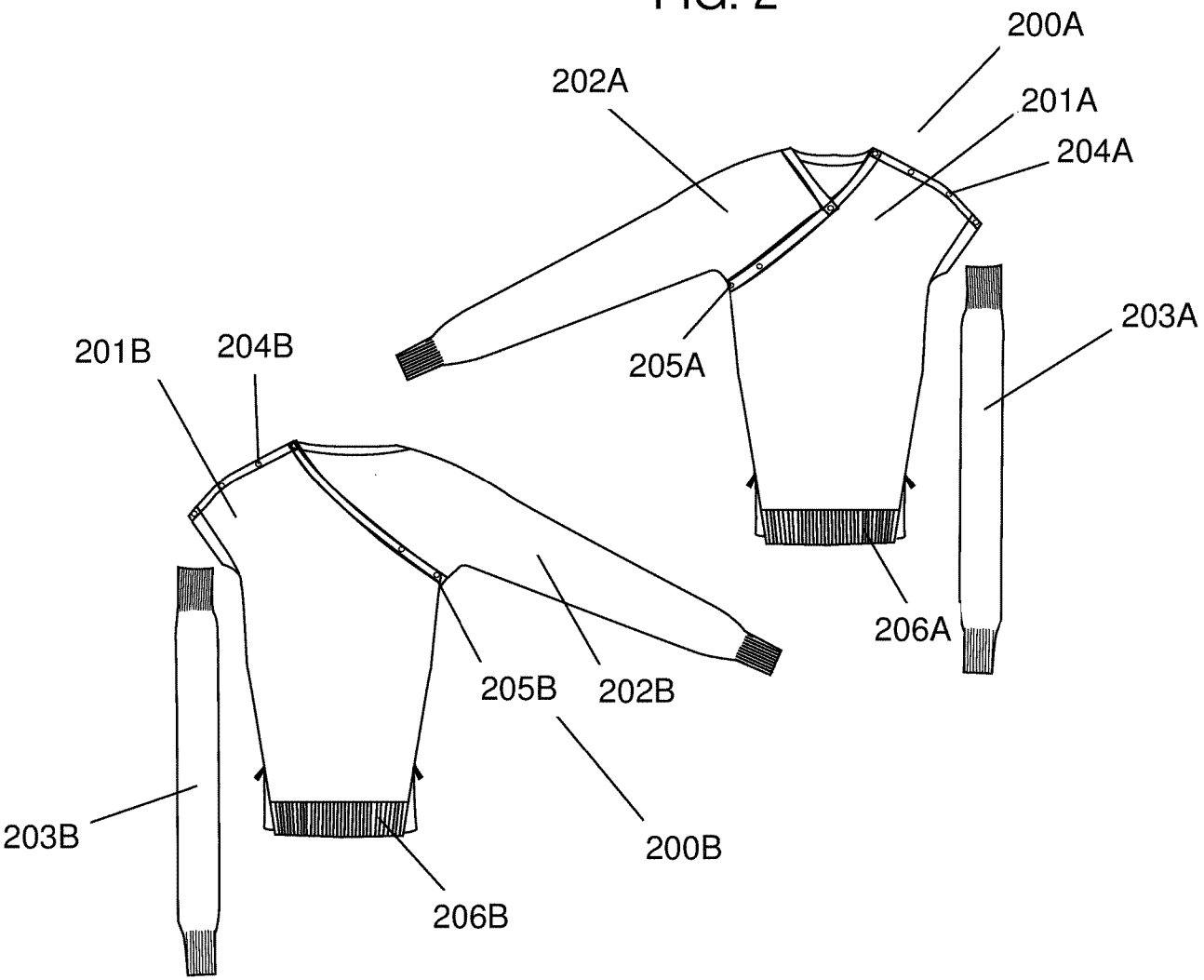
FIG. 2 illustrates a convertible apparel, in accordance with an embodiment of the present invention.

FIG. 2 illustrates front view 200*a* and rear view 200*b* of an embodiment of convertible apparel, as shown on FIG. 1. Front view 200*a* of convertible apparel illustrates front view of bodice 201*a* having a plurality of fasteners 204*a*, a plurality of fasteners 205*a*, and waistline 206*a*, wherein a detachable right sleeve 202*a* is detachably attached to bodice 201*a* by the plurality of fasteners 205*a*. In an embodiment, detachable left sleeve 203*a* is shown to be worn without being attached to bodice 201*a* by any fastening means. Rear view 200*b* of convertible apparel illustrates rear view of bodice 201*b* having a plurality of fasteners 204*b*, a plurality of fasteners 205*b*, and waistline 206*b*, wherein a detachable right sleeve 202*b* is detachably attached to bodice 201*b* by the plurality of fasteners 205*b*. Detachable left sleeve 203*b* is shown to be worn without being attached to bodice 201*b* by any fastening means.

Figure 3:
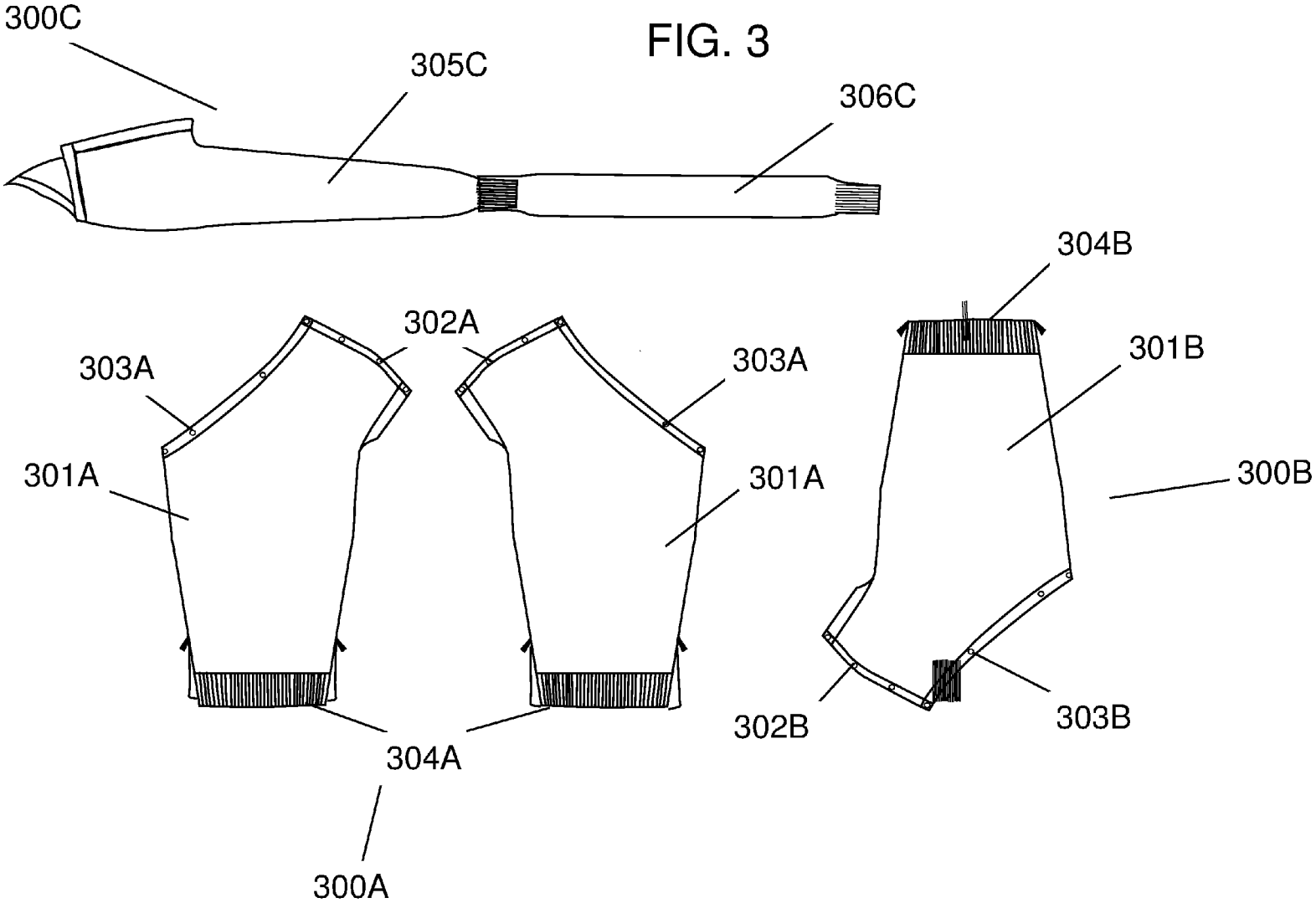
FIG. 3 illustrates one other embodiment of the convertible apparel, in accordance with an embodiment of the present invention.
Figure 7:
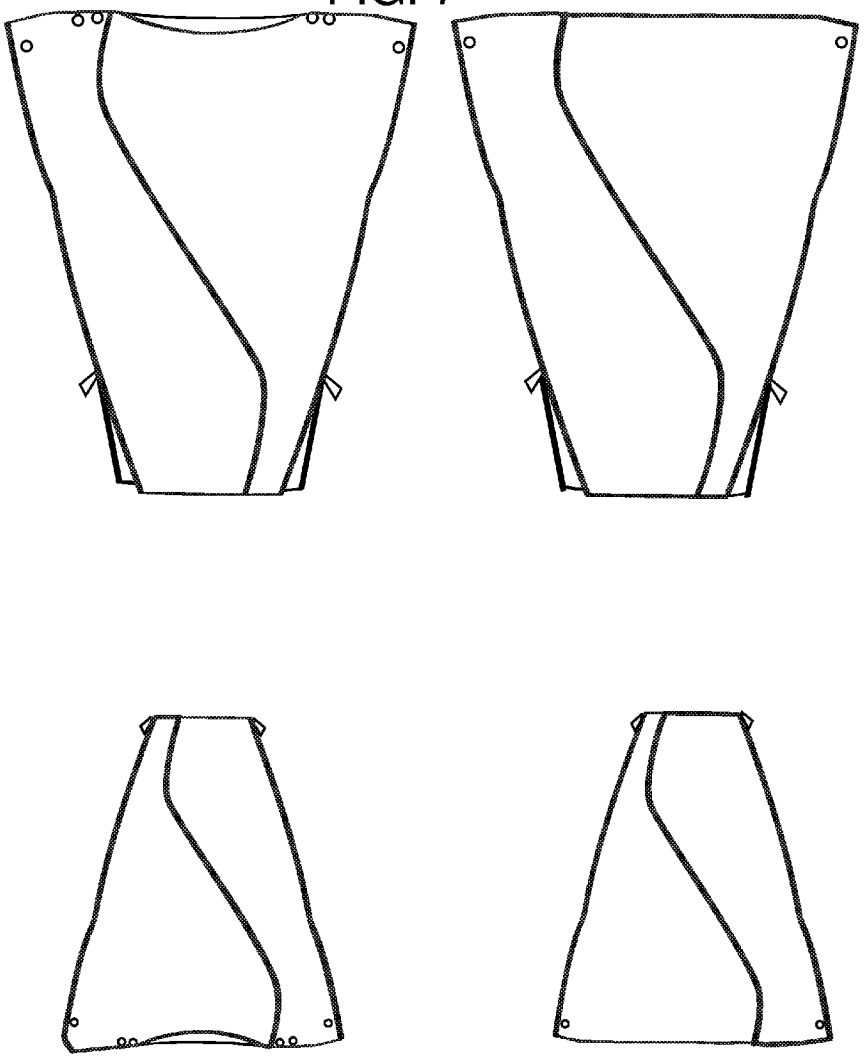
FIG. 7 illustrates detachable sleeves, in accordance with an embodiment of the present invention.
Figure 8:
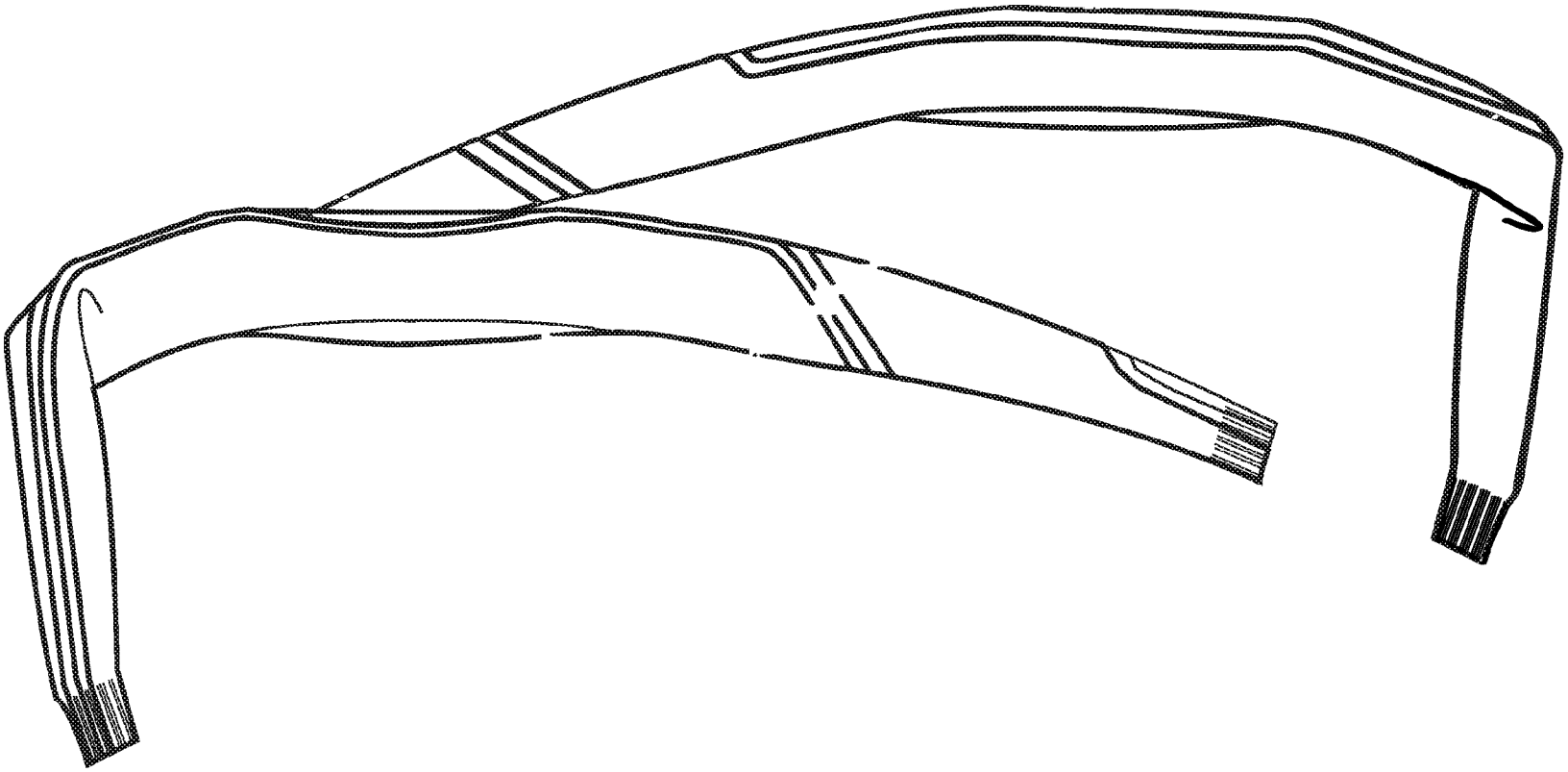
FIG. 8 illustrates a bodice of a convertible apparel, in accordance with an embodiment of the present invention.

FIG. 3 illustrates three embodiments of convertible apparel. Embodiment 300*a* illustrates front view and rear view of sleeveless bodice 301*a* shown in its "top/blouse" view and having a plurality of fasteners 302*a*, a plurality of fasteners 303*a*, and waist line 304*a*. Embodiment 300*b* illustrates an upside down view of sleeveless bodice 301*b* in its "bustier" or "skirt" configuration, where plurality of fasteners 302*b* and plurality of fasteners 303*b* are in its unfastened configuration and are located in close proximity of edge forming a hemline of the convertible apparel, and where waist line 304*a* is transformed into a hemline 304*b* of convertible apparel presented in its "bustier" or "skirt" configuration. Embodiment 300*c* illustrates detachable sleeve 305*c* and detachable sleeve 306*c* interconnected with each other to form a scarf, a headwear, or a belt. It is to be understood that configuration of convertible apparel illustrated in FIGS. 1-3 may differ such that bodice may be constructed as a vest or other sleeveless top, as illustrated in FIG. 7, constructed to enable connection of detachable sleeves thereto. It is also to be understood that a plurality of detachable sleeves may be replaced by a shrug, as illustrated in FIG. 8.

Figure 4:
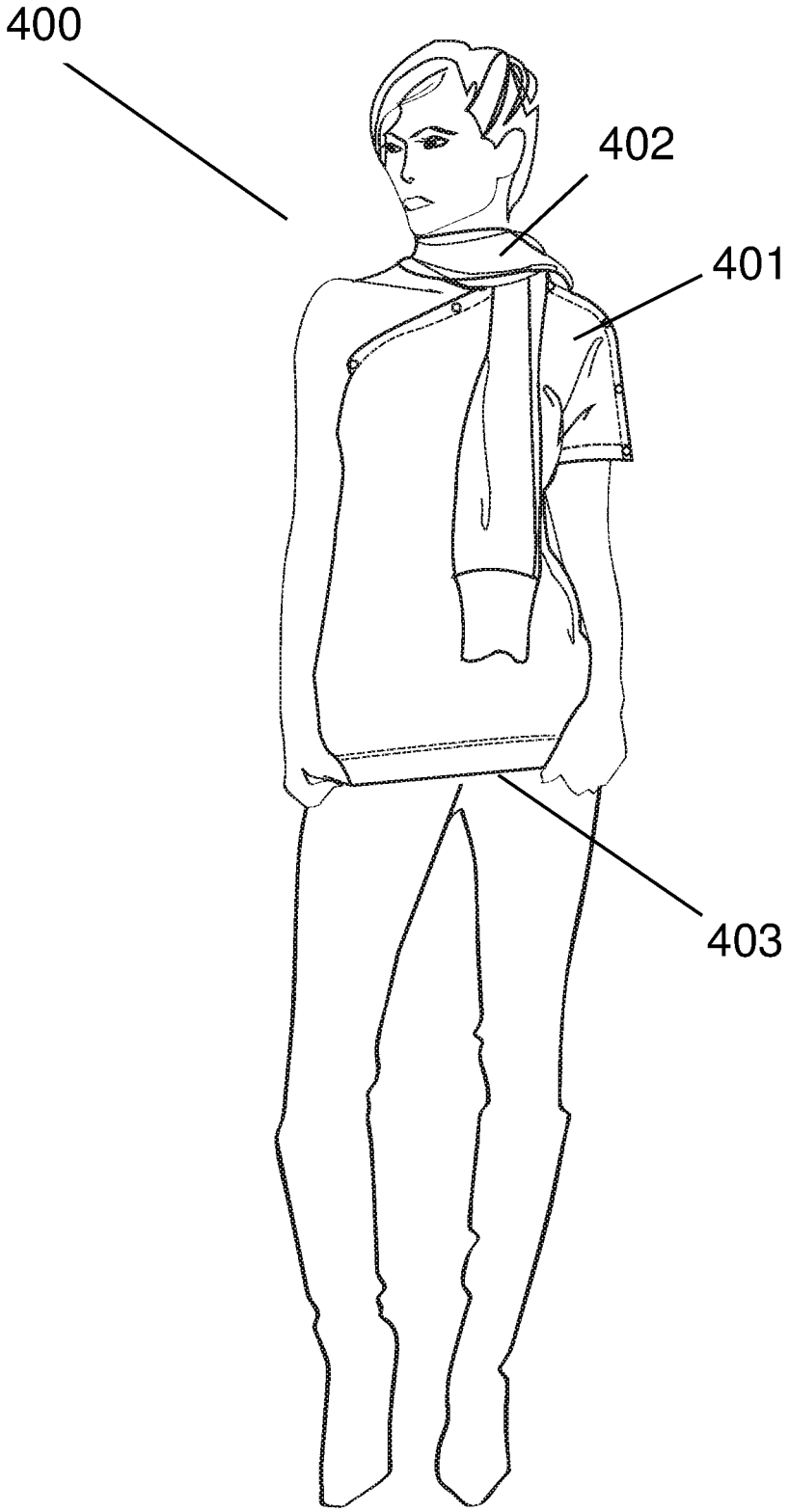
FIG. 4 illustrates a convertible apparel worn by a wearer in its configuration of a sleeveless top and a scarf constructed from the detachable sleeves, in accordance with an embodiment of the present invention.

FIG. 4 illustrates a convertible apparel transformed from a top with two detachable sleeves, as shown in FIG. 1, into a sleeveless top and a scarf constructed from the detachable sleeves. Specifically, FIG. 4 illustrates a bodice 401 worn as a sleeveless top having a hemline 403, wherein bodice 401 is worn together with a scarf 402 constructed from a detachable sleeve 102 and detachable sleeve 103, as shown in FIG. 1.

Figure 5:
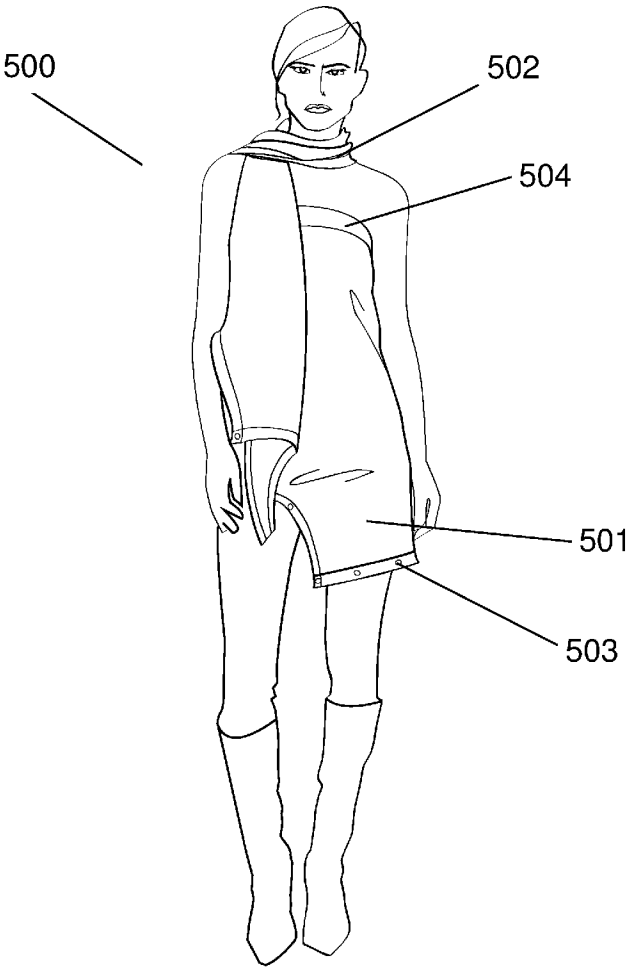
FIG. 5 illustrates a convertible apparel worn by a wearer in its configuration of a bustier dress along with a combination of two detachable sleeves constructed and worn as a scarf, in accordance with an embodiment of the present invention.

FIG. 5 illustrates a convertible apparel comprising bodice 401 transformed from a sleeveless top, as shown in FIG. 4 into a bustier 501. Specifically, transformation of bodice 401 from sleeveless top into a bustier is effectuated by flipping bodice 401 upside down such that hemline of the sleeveless top shown in FIG. 4 becomes a neckline 504 of bustier 501 where hemline of bustier 501 is a neckline of the sleeveless top shown in FIG. 4. Bustier 501 in FIG. 5 is depicted in combination of scarf 502 constructed from a detachable sleeve 102 and detachable sleeve 103, as shown in FIG. 1.

Figure 6:
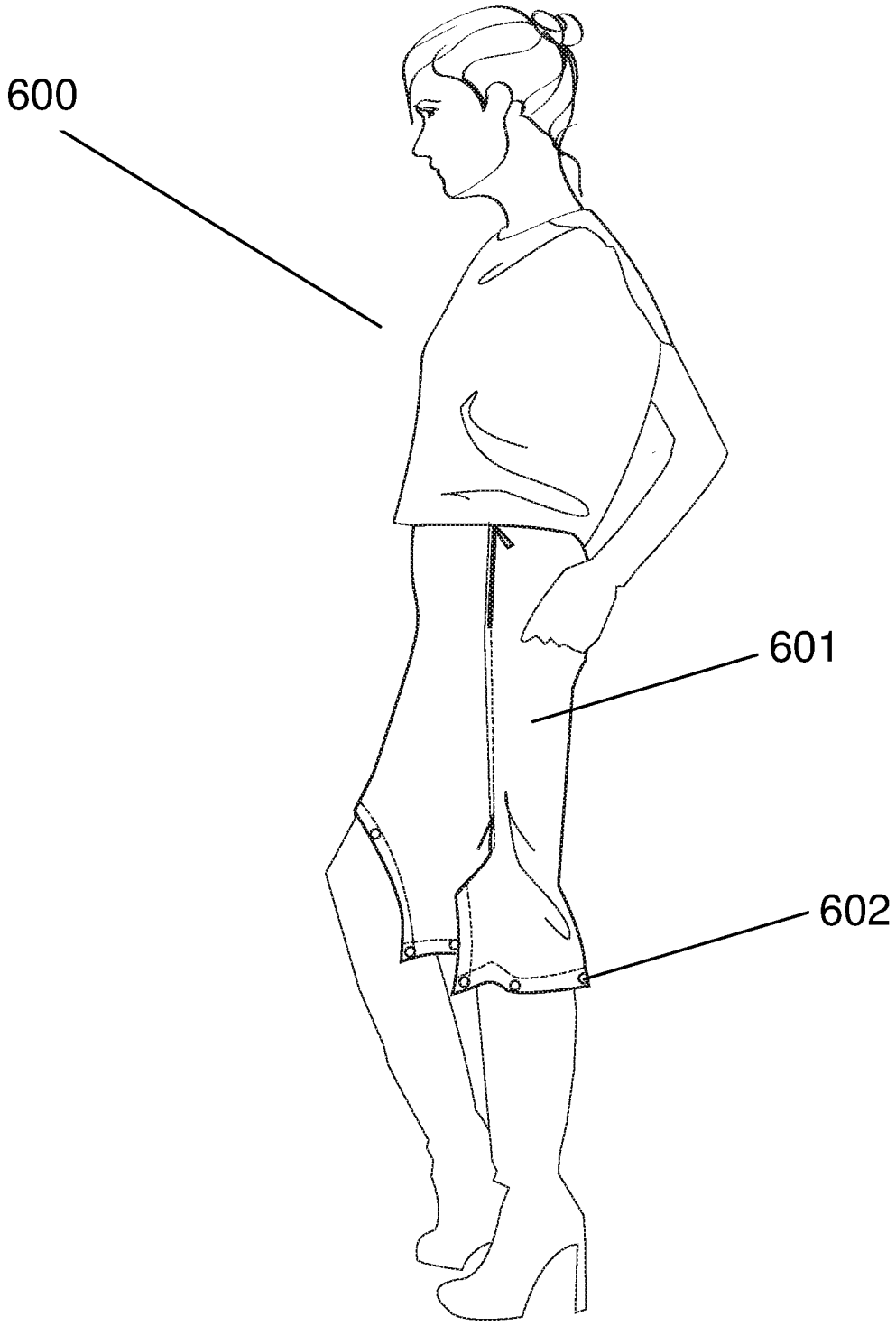
FIG. 6 illustrates a bodice of a convertible apparel worn by a wearer in its configuration of a skirt, in accordance with an embodiment of the present invention.

In yet other embodiment, shown in FIG. 6, convertible apparel is illustrated to be converted into a skirt 601. Specifically, FIG. 6 illustrates transformation of sleeveless top 401, as shown in FIG. 4 or of bustier 501, as shown in FIG. 5, into a skirt 601, wherein neckline of a sleeveless top 401 or of bustier 501 becomes a waistline of skirt 601 and wherein neckline of sleeveless top 401 or of bustier 501 (along with plurality of fasteners 302 and plurality of fasteners 303, as shown in FIG. 3) now forms a hemline 602. In an embodiment, the hem of the skirt 601 has a drawstring that allows the wearer to manipulate the silhouette of skirt 601 and adjust the width of the neckline when it's worn as a top. The silhouette can be changed from A-line to Oval shape and when it's worn as a top it has a flipped trapeze shape.

Any element in a claim that does not explicitly state "means for" performing a specified function, or "step for" performing a specific function, is not to be interpreted as a "means" or "step" clause as specified in 35 U.S.C § 112, ¶6. In particular, the use of "step of" in the claims herein is not intended to invoke the provisions of 35 U.S.C § 112, ¶6.

While multiple embodiments are disclosed and the foregoing description includes details which will enable those skilled in the art to practice the invention, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive. They are not exhaustive and do not limit the claimed inventions to the precise forms disclosed. The claims and their equivalents define the scope of the invention.

What is claimed is:

1. A multipurpose customizable garment comprising:
a first detachable sleeve; and
a second detachable sleeve; and
a torso element comprising an upper opening, a lower opening, a pair of side openings, and a dimension-regulating element, wherein the first detachable sleeve and the second detachable sleeve are detachably coupled with the torso element, wherein the first detachable sleeve and the second detachable sleeve are convertible into a second multipurpose customizable garment by detachably connecting a cuff of the first detachable sleeve to a cuff of the second detachable sleeve.

2. The multipurpose customizable garment of claim 1, wherein the dimension-regulating element adjusts the lower opening of the torso element.

3. The multipurpose customizable garment of claim 1, wherein the first detachable sleeve is detachable connected to the second detachable sleeve using a second plurality of fasteners.

4. The multipurpose customizable garment of claim 1, wherein the upper opening of the torso element is a neckline and wherein the lower opening is a hemline.

5. A method of converting a first multipurpose customizable garment into a second multipurpose customizable garment, the method comprising:
detaching a first detachable sleeve and a second detachable sleeve from a torso element of a multipurpose customizable garment having an upper opening, a lower opening and a pair of side openings;
rotating the torso element upside down; and
adjusting dimensions of the lower opening using a dimension-regulating element situated in a close proximity to the lower opening.

6. The method of claim 5 further comprising:
detachably interconnecting a cuff of the first detachable sleeve and a cuff of the second detachable sleeve.

7. The method of claim 6, wherein detachably interconnecting a cuff of the first detachable sleeve and a cuff of the second detachable sleeve comprises detachably interconnecting a cuff of the first detachable sleeve and a cuff of the second detachable sleeve using a plurality of fasteners.

8. The method of claim 5, wherein adjusting dimensions of the lower opening using a dimension-regulating element comprises expending dimensions of the lower opening.

9. The method of claim 5, wherein adjusting dimensions of the lower opening using a dimension-regulating element comprises reducing dimensions of the lower opening.

10. The method of claim 5, wherein the first multipurpose customizable garment is one of:
a sleeveless top;
a sleeveless blouse;
a vest; and
a t-shirt.

11. The method of claim 5, wherein the second multipurpose customizable garment is one of:

a bustier;

a strapless dress; and a skirt.

12. The method of claim 6, wherein detachably interconnecting a cuff of the first detachable sleeve and a cuff of the second detachable sleeve forms a third multipurpose customizable garment.

13. The method of claim 12, wherein the third multipurpose customizable garment is one of:

a scarf;

a belt; and a headwear.

* * * * *